US005358026A

United States Patent [19]

Simpson

[11] Patent Number: 5,358,026

[45] Date of Patent: Oct. 25, 1994

[54] INVESTMENT CASTING PROCESS

[76] Inventor: Neil A. A. Simpson, Burn of Daff Farm, Downies, Portlethen, Aberdeen AB1 4QX, United Kingdom

[21] Appl. No.: 178,940

[22] PCT Filed: Aug. 2, 1989

[86] PCT No.: PCT/GB89/00881

§ 371 Date: Apr. 2, 1991

§ 102(e) Date: Apr. 2, 1991

[87] PCT Pub. No.: WO90/01384

PCT Pub. Date: Feb. 22, 1990

Related U.S. Application Data

[63] Continuation of Ser. No. 52,862, Apr. 26, 1993, abandoned, which is a continuation of Ser. No. 669,420, Apr. 2, 1991, abandoned.

[30] Foreign Application Priority Data

Aug. 2, 1988 [GB] United Kingdom ..... 8818382.7
Sep. 14, 1988 [GB] United Kingdom ..... 8821521.5

[51] Int. Cl.[5] ..... B22D 19/00; B22C 9/04

[52] U.S. Cl. ..... 164/98; 164/34; 164/112

[58] Field of Search ..... 164/91, 98, 100, 102, 164/104, 111, 112, 34, 35, 46

[56] References Cited

U.S. PATENT DOCUMENTS

| | | | |
|---|---|---|---|
| 1,676,887 | 7/1928 | Chamberlin | 175/403 |
| 2,381,415 | 8/1945 | Williams | 175/400 |
| 3,754,593 | 8/1973 | Stone | 164/95 |
| 3,757,879 | 9/1973 | Wilder | 175/329 |
| 3,945,070 | 3/1976 | Hauser | 164/111 |
| 4,023,613 | 5/1977 | Uebayasi | 164/111 |
| 4,352,400 | 10/1982 | Grappendorf | 175/394 |
| 4,423,646 | 1/1984 | Bernhardt | 164/97 |
| 4,499,795 | 2/1985 | Radtke | 164/108 |
| 4,669,522 | 6/1987 | Griffin | 164/80 |

FOREIGN PATENT DOCUMENTS

| | | | |
|---|---|---|---|
| 60949 | 7/1865 | Australia . | |
| 59-30465 | 2/1984 | Japan | 164/102 |
| 59-174262 | 10/1984 | Japan | 164/100 |
| 61-23822 | 2/1986 | Japan | 164/100 |
| 63-183771 | 7/1988 | Japan | 164/102 |
| 556007 | 3/1942 | United Kingdom . | |

*Primary Examiner*—P. Austin Bradley
*Assistant Examiner*—Rex E. Pelto
*Attorney, Agent, or Firm*—Ratner & Prestia

[57] ABSTRACT

A method of manufacturing one-piece composite drill bits or coreheads suitable for drilling or coring petroleum wells or in mining. A shell (32) of hard wear-resistant and erosion-resistant material is formed by investment casting in a finished form requiring nominal or no finish shaping. A shank (44) of machinable material is then cast inside the shell, in conditions which cause fusion bonding of the two materials to form a one-piece composite drill bit (42) or corehead by the two-stage casting procedure. The shank (44) is finish machined to form a connection for attachment to a drill string. Pockets (20) for cutter inserts and gauge protectors can be pre-formed to final dimensions in the hard shell (32). The investment mold for the shell (24) allows the hard material to be cast in the required shape with little or no final shaping. The method enables drill bits and coreheads to be manufactured at relatively low cast by eliminating most or all skilled manual finishing operations.

2 Claims, 6 Drawing Sheets

INVESTMENT CASTING PROCESS

This application is a continuation of application Ser. No. 08/052,862 filed Apr. 26, 1993 now abandoned, which is a continuation of Ser. No. 07/669,420 filed Apr. 2, 1991 now abandoned.

This invention relates to a method of manufacturing petroleum/mining drill bits/coreheads with synthetic and natural diamond materials by utilising investment casting methods.

Current methods for producing drill bits/coreheads utilise a matrix or a steel body.

In the matrix type, tungsten carbide powder matrix is formed in a thick shell around a steel inner core which carries the threaded connection. The cutters are then brazed on to the pre-formed matrix shell.

This method is suitable since the tungsten carbide matrix is very resistant to fluid erosion and abrasive wear, natural diamonds can be included in the matrix shell for gauge protection, and relatively complex shapes can be produced.

However, the method suffers from the disadvantages that possible breakdown of bond between the matrix shell and steel core may occur, manufacture of the graphite mould is precision work requiring high labour input, and high cost due to quantity of carbide required.

Also, the differential of contraction between matrix shell or steel core may cause cracking especially in the larger products and further, poor quality of the matrix body formed necessitates extensive hand fettling.

In the steel body type, the normal method of manufacture is by machining from the solid using multi-axis milling machines and then hard-facing using welding or spray metal techniques prior to the installation of the cutters. These cutters are either brazed in place or pressed into prepared holes and held in place by interference fit.

The advantages of the steel body type are a single unit construction with no possibility of break-up due to bond failure or cracking, low cost materials, and CNC multi-axis milling machine techniques give good repeatability for batch production.

However, the steel body type method is labour intensive, in that hard facing has to be applied after machining, and any surplus hard facing has to be hand-ground away from cutter pockets prior to installation. Also, the allowable complexity of shape is restricted by limitations of machining capabilities.

It has previously not been considered a viable solution to manufacture drill bits/coreheads utilising investment casting techniques; the matrix and CNC machining approach being far more established and understood than this hitherto unknown method of manufacturing.

The accepted standard method of manufacturing an investment casting for industrial products such as aircraft turbine blades and engine components is as follows:

A master mould is manufactured to cast accurate wax males of the product required. The wax males are then coated with a ceramic material by dipping them in a slurry and then raining sand on the wet slurry. This is done a number of times, allowing the slurry and sand coating to dry before re-dipping.

In this way, a thick coating of material is built up around the wax male. The coated wax male is then furnaced to bake the coating and melt out the wax, thus creating an accurate ceramic mould of the product to be cast.

Under normal circumstances, this method of manufacture would not be used to produce a steel-bodied bit or corehead due to the fact that it would require subsequent hard facing after casting in order to withstand the fluid erosion and abrasive wear experienced downhole. The application of this hard facing by spray metal or welding techniques would cover or damage the accurately-formed profile of the investment cast product thus spoiling the dimensional accuracy and therefore defeating the purpose of using this process in the first place.

It is an object of the invention to obviate or mitigate the above disadvantages by utilising the investment casting process in a novel method of manufacture to product a highly accurate and, if required, complex casting, which needs little refinishing prior to installation of the cutters.

According to a first aspect of the present invention, there is provided a method of casting a drill bit or corehead, said method comprising a two-stage process wherein the first stage comprises forming a relatively hard outer shell by investment casting, and the second stage comprises casting a relatively less hard core within the outer shell in conditions which cause fusion bonding of shell and core, the outer shell having substantially the final form of the outer part of the intended drill bit or corehead, and the core having at least principal features of the final form of the shank of the drill bit or corehead.

According to a second aspect of the present invention, there is provided a method of casting a drill bit or corehead, said method comprising the steps of forming or providing at least the basis of a shank of the drill bit or corehead, the shank or proto-shank being of a relatively less hard material, buttering the shank (or proto-shank) with weld material or spray metal deposit of lower melting temperature than that of a material subsequently to form an outer shell of the drill bit or corehead, forming or providing a ceramic mould of the bit head, suspending the pre-buttered shank or proto-shank in the ceramic mould, pre-heating the ceramic mould and shank (or proto-shank) to a predetermined casting temperature, and casting the relatively hard material around the shank (or proto-shank) to be fusion bonded thereto and to form a relatively hard outer shell around the shank.

According to a third aspect of the present invention there is provided a drill bit or corehead, manufactured by the method according either to the first aspect of the present invention, or to the second aspect of the present invention.

The method of the invention combines the advantages of both matrix and steel bodied type production, substantially reducing the labour content per manufactured unit, thus greatly enhancing the possibilities of mass production.

In order to achieve a product which would fulfil the requirement of the industry, it was necessary to devise a method of investment casting a hard bit body whilst retaining a tough machinable central core. This was achieved by casting the bit body utilising investment casting methods.

In accordance with the invention, the drill bit/corehead is made by two separate casting stages in a two-part manufacturing process, the body being cast in separate casts as follows:

Cast 1: to create a very hard and fluid erosion resistant outer shell which has the accuracy of outer form that the investment casting could produce.

Cast 2: to cast within this shell a central core which was tough yet machinable, in such a way that fusion bonding of the two materials is achieved and the final casting is a single piece of material incorporating a tough central core and having an outer casing of hard material which is highly resistant to abrasive wear and erosion wear.

The purpose of producing the bit in a two-step casting is that the bit shank requires different properties to the bit head i.e. the bit head requires to be resistant to abrasive wear and to be resistant to fluid erosion whereas the shank requires to be easily machinable and to have the capability of withstanding high stress-/fatigue levels.

These properties are not realistically achievable from one material.

The complex form of a drill bit head is difficult and expensive to machine and therefore lends itself to the investment casting process. The bit shank on the other hand is less critical and can be sand cast or investment cast and machined to size at a later stage.

In addition to creating an investment cast drill bit/-core head with the hard facing in situ, the internal hydraulic manifolding required to direct fluid to the nozzles in the bits used for cooling and cleaning, could be cast in situ in the second cast by installing this prefabricated ceramic into the shell of the first cast and casting around; thereby creating the bit complete with its manifolding in a two-step casting process.

However, inclusion of the manifold may be omitted if so necessitated by the design.

In carrying out this novel manufacturing process, a preferred preliminary stage is to produce an accurate male wax model of the bit head to be cast. This can be achieved in a number of ways:

Method 1—it can be machined from the solid piece of wax attached to a mandrel. (This is a particularly useful approach for prototyping or batch production.)

Method 2—wax injection mould dies can be manufactured for the particular component and injection mould wax males can be produced. (Suitable for mass production).

Method 3—a combination of methods 1 and 2 can be used i.e. injection mould the basic shape and carry out minor machining on the wax. (This allows for greater flexibility for cutter and gauge protection slug positioning while maintaining the advantages of relatively low cost mass produced waxes).

Method 4—wax injection mould can be produced for the bit in component form and these mass produced component parts assembled at the wax stage to produce a variety of bits. (This allows for mass production of a variety of products at relatively low cost).

The preferred second stage of manufacture is to produce a ceramic mould from the wax male which has been produced by one of the above methods. This may be done by the conventional investment casting method as previously described.

The preferred third stage is to make an investment casting by pouring molten alloy into the prepared ceramic mould thus producing an exact copy of the original wax male. This casting material should be highly resistant to abrasive wear and fluid erosion in its cast stage e.g. the high-cobalt alloys such as stellite. The resultant casting preferably incorporates all the cutter and gauge slug pockets to a high degree of accuracy. It may also include fluid porting and nozzle positions together with an internal attachment profile such as thread slots or keyways.

The preferred fourth stage, after casting and cleaning, is to fit the internal ceramic components into position within the hard shell and prepare the hard shell for the second casting operation. The shell from the first cast is therefore now set in a sand mould bed with the shank form created using sand or ceramic moulding techniques.

The preferred fifth stage is to pre-heat the combined mould before the second cast to such a level that it takes into account the temperatures, masses and specific heat values of the two materials being combined such that a percentage of the inner skin of the outer shell is melted down to form a fusion bond between the two materials. This will cause alloying of the two materials causing fusion bonding to take place between the hard outer shell and the softer but tougher inner core material. Latent heat of fusion plays a major role in this process, ensuring that fusion bonding can take place without total melt-down of the shell. A suitable pre-heat temperature of the shell can be determined by taking into account the relative masses and respective temperatures of the shell and the material poured to product the inner core.

After this second casting process, a product will have been manufactured which has an accurately-formed, hard wear-resistant outer shell fusion bonded onto a tough machinable inner core.

This will have particular application to the manufacture of drill bits/coreheads for the petroleum and mining industries.

It should also be noted that the manufacturing process described above is flexible and is capable of being reversed, by casting the hard material around the shank as follows:

Step 1: form or provide a shank (or at least the basis of a shank, to be finished subsequently), by casting or by any other suitable process;

Step 2: butter the shank with weld material or spray metal deposit, of lower melting temperature than the material of the cast shell;

Step 3: form or provide a ceramic mould of the bit head;

Step 4: suspend this pre-buttered shank in the ceramic mould of the bit head;

Step 5: pre-heat the ceramic mould and shank assembly to correct casting temperature; and Step 6: cast the hard material around the shank to form a hard shell.

Embodiments of the manufacturing process will now be described, by way of example, with reference to the accompanying drawings, in which.

Figure 1:
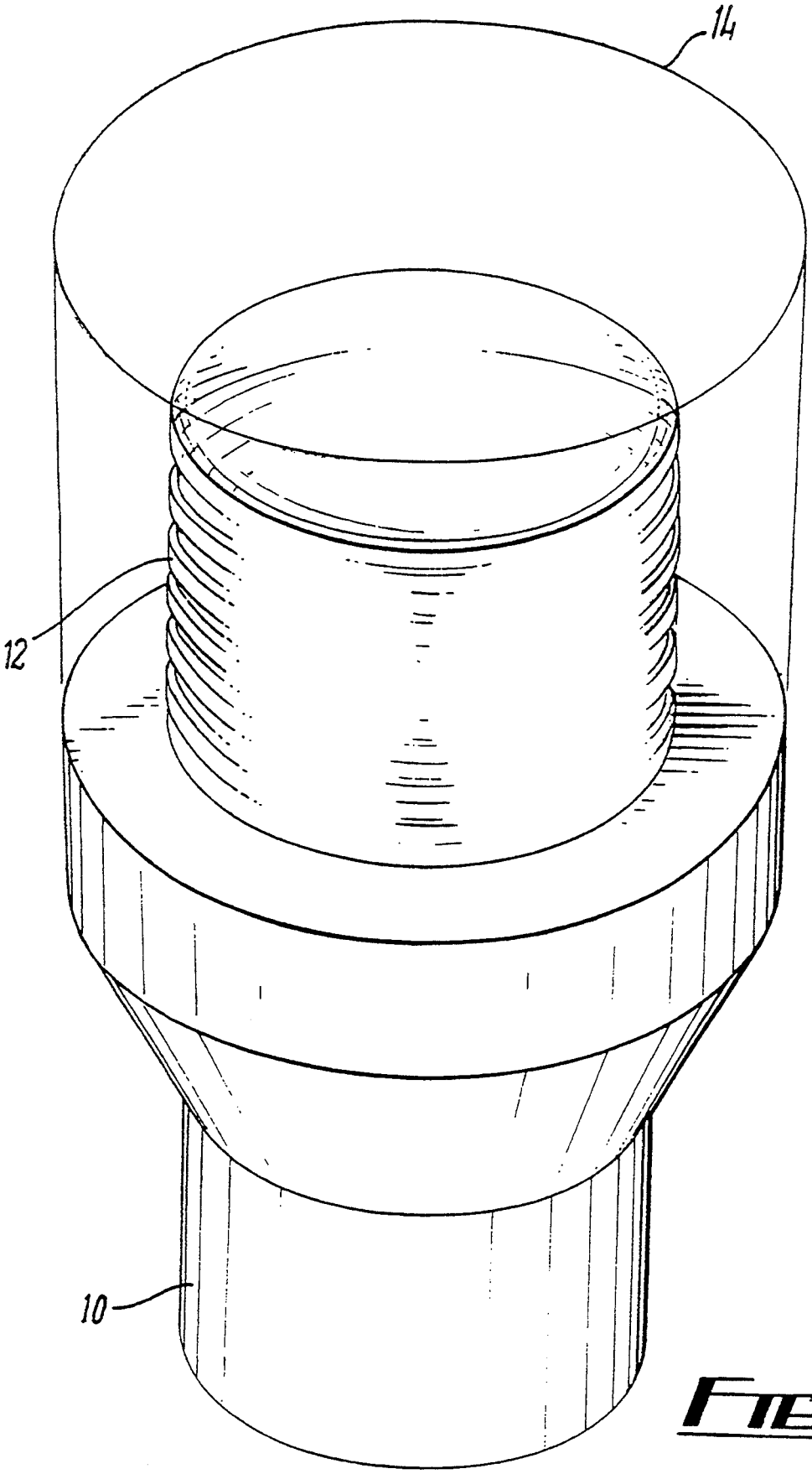
FIG. 1 is a wax block cast onto an alloy mandrel ready for machining.

Referring first to FIG. 1, an alloy mandrel 10 has an attachment thread 12 formed on one end. A wax block 14 (shown in ghost outline) is cast around the thread 12 to form an assembly ready for machining to shape.

Figure 2:
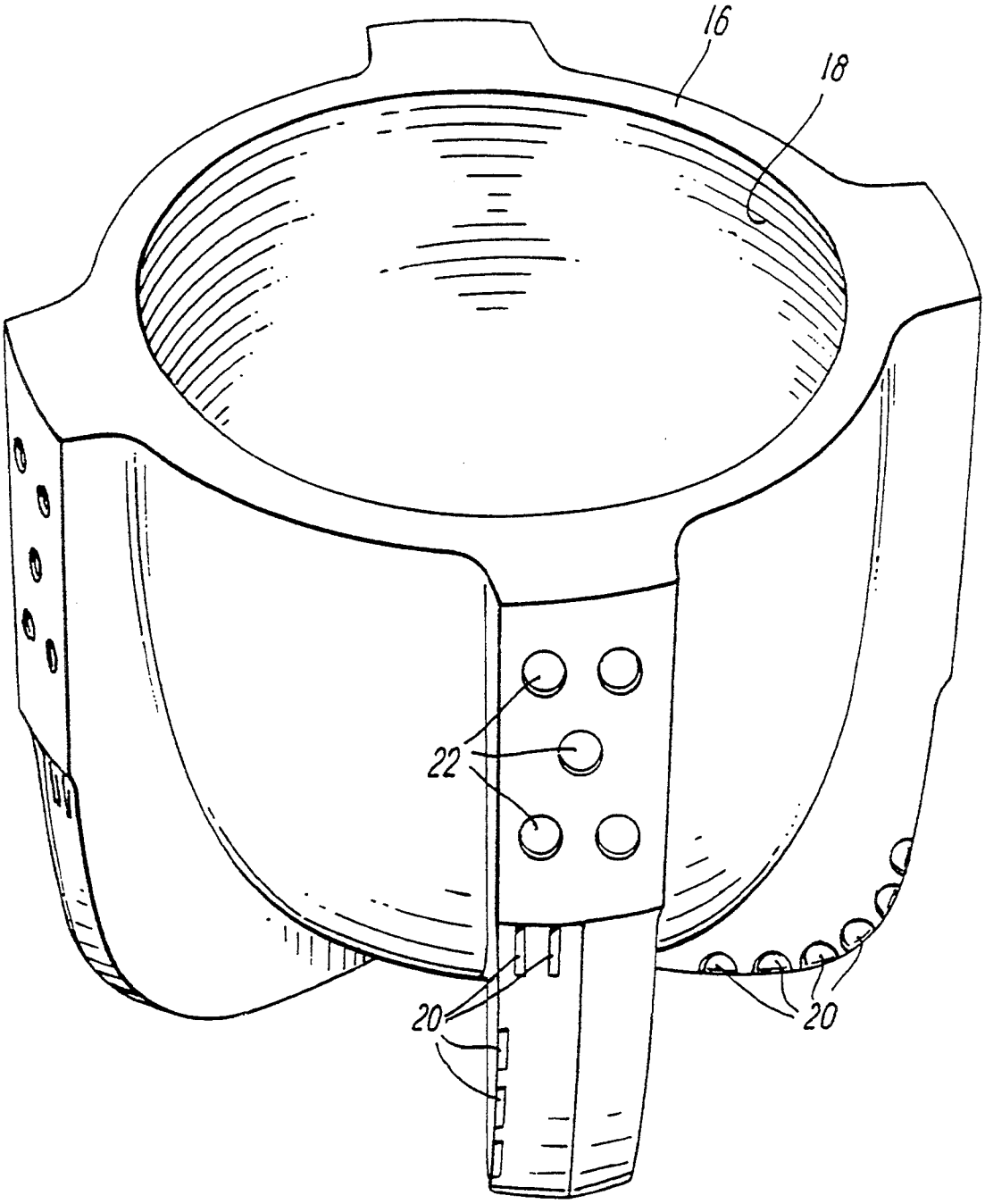
FIG. 2 is a wax shell of a typical drill bit head or crown, taken off the mandrel after machining.

FIG. 2 shows a wax shell 16 as typically machined from the block 14, and unscrewed from the thread 12 to leave an internal attachment thread 18. The cutter shell 16 has a four-bladed form, with pockets 20 on the blade edges for subsequent mounting of cutter inserts, and side-face pockets 22 for subsequent insertion of hard inserts to maintain cutter gauge against diameter reduction by wear. As an alternative to being machined, the wax shell 16 could be formed by injection moulding.

Figure 3:
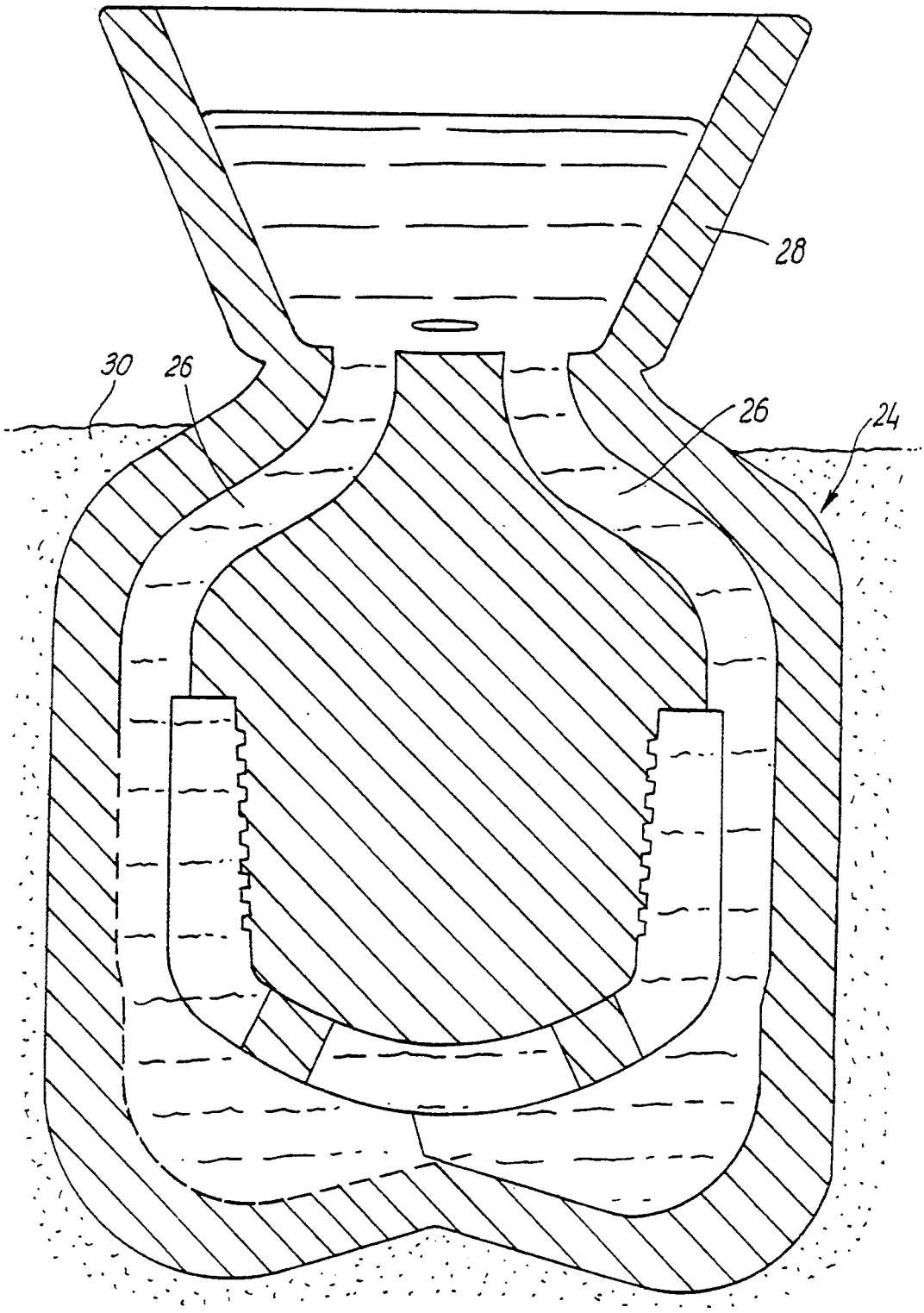
FIG. 3 is a cross-section of the ceramic mould for the first phase of casting.

A ceramic mould 24 (FIG. 3) is formed from the wax shell 16, the mould including runners 26 and a riser 28 for the pouring in of liquid metal. The ceramic mould 16 is mechanically supported in a bed of sand 30 during the first stage of the casting process.

Figure 4:
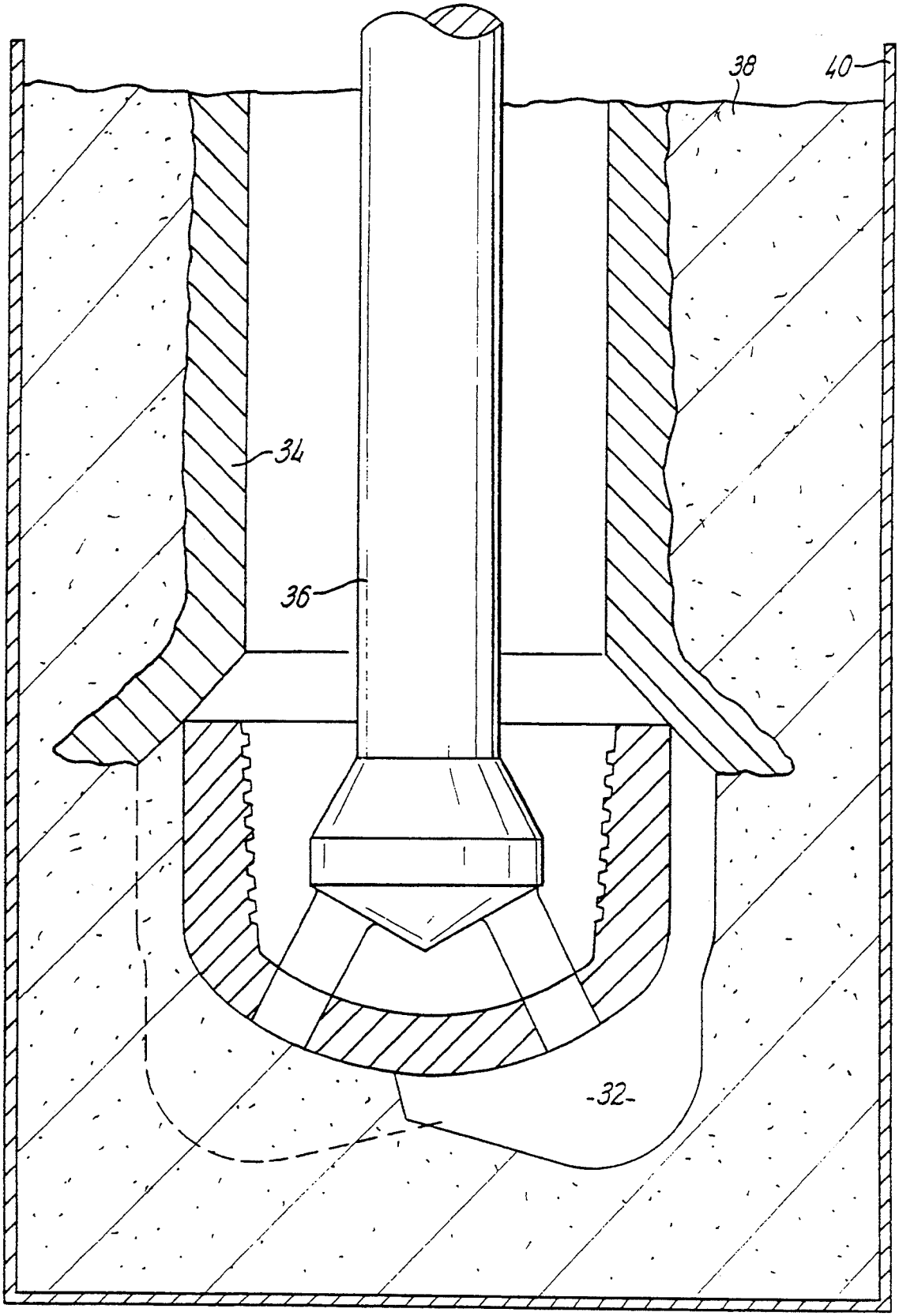
FIG. 4 shows the second phase of casting with a manifold in position.

FIG. 4 shows the second stage of casting, in which the first-stage casting 32 (with risers removed) is placed against a ceramic shank mould 34. A ceramic manifold insert 36 is placed within the casting 32 to form a manifold in the second-stage casting. The assembly of first-stage casting 32 and shank mould 34 is mounted within and supported by sand 38 held in a drum 40.

Figure 5:
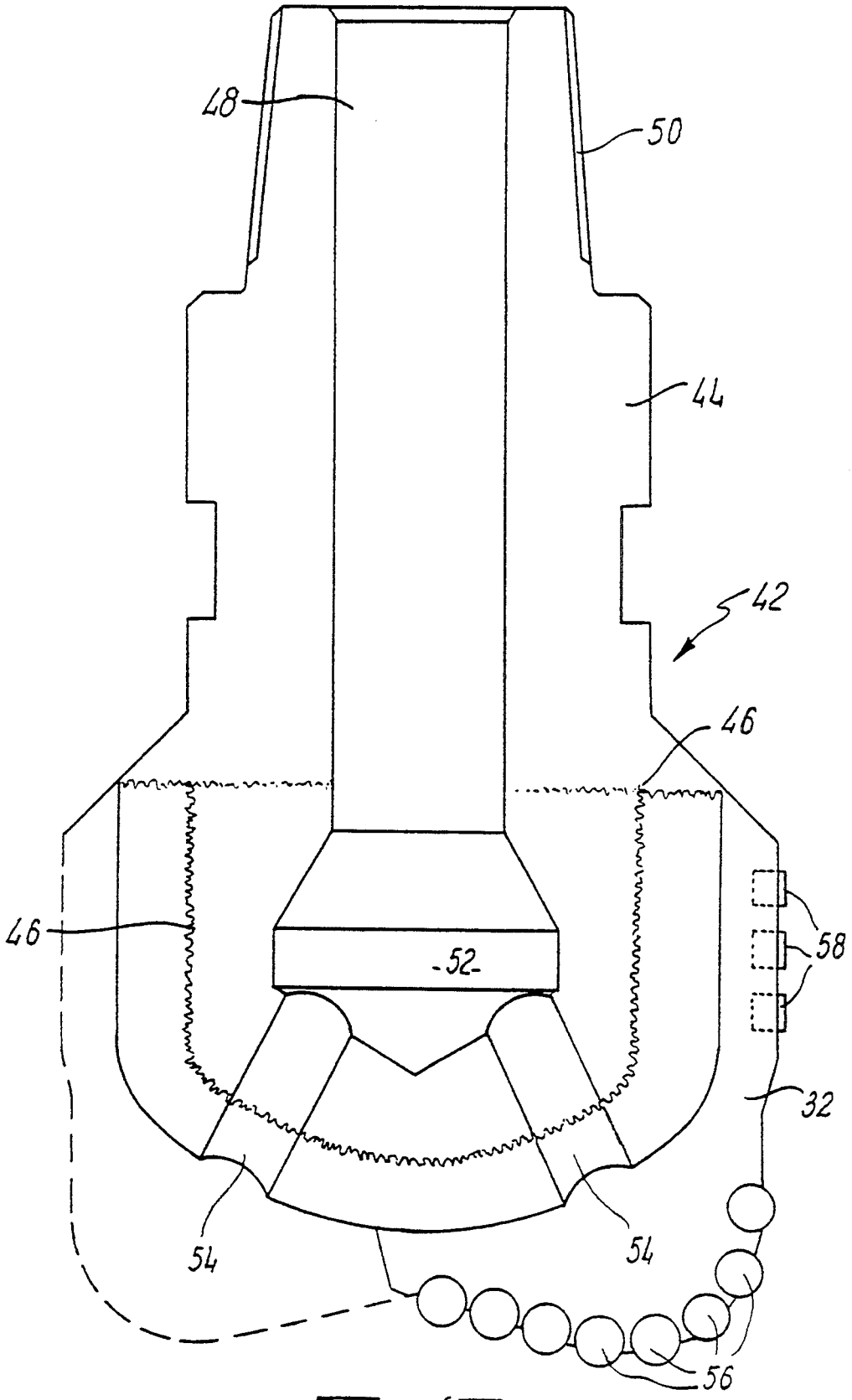
FIG. 5 shows a cross-section of the completed bit body, ready for installation of cutters and gauge protection slugs.
Figure 6:
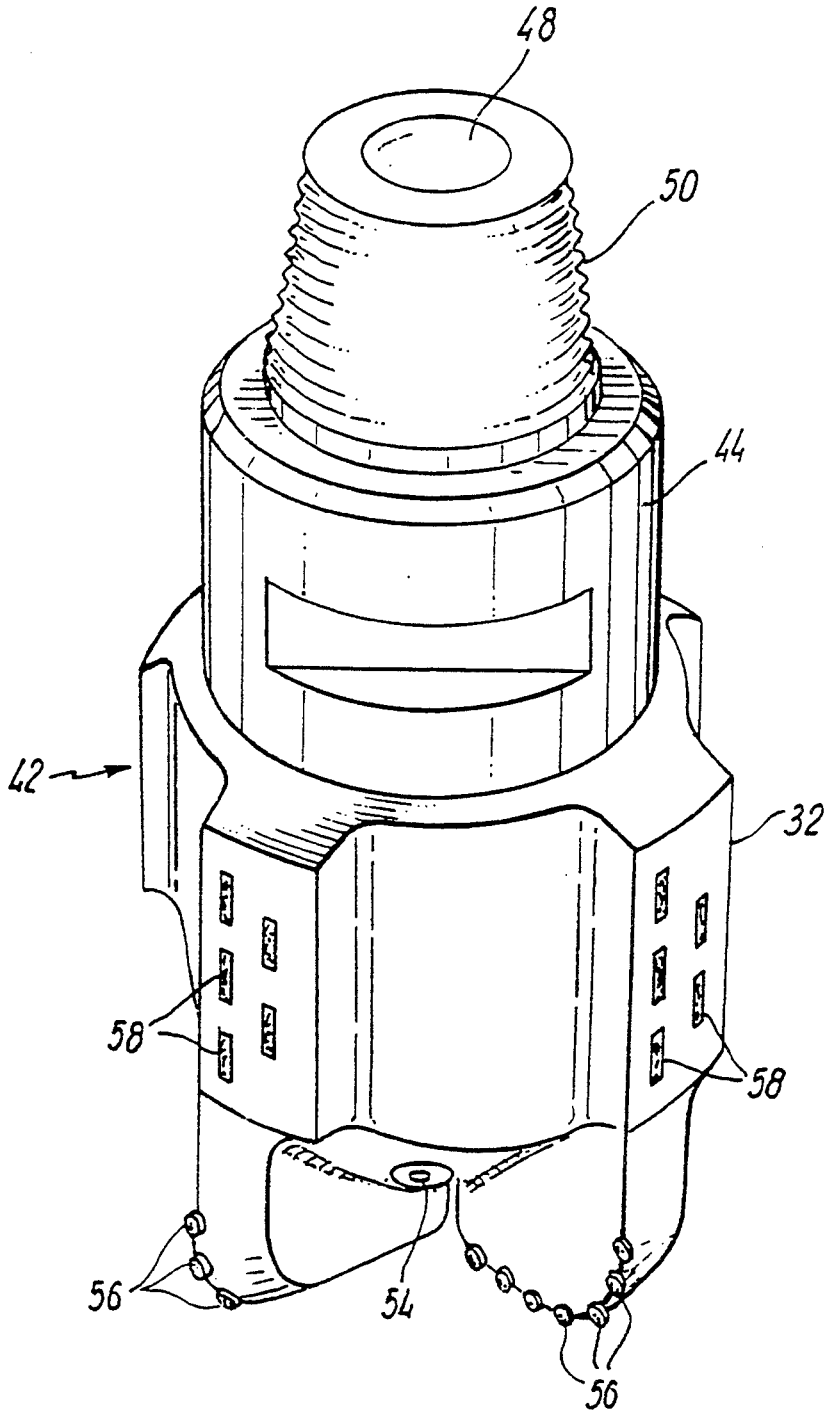
FIG. 6 is a perspective view of the completed drill bit.

FIGS. 5 and 6 show the composite casting 42 resulting from the second stage of the moulding process. The composite casting 42 includes a bit shank 44 fusion bonded to the hard first-stage casting 32 along a fusion bond line or zone 46. A central conduit 48 runs from a connector 50 on the bit shank 44 through to a flow manifold chamber 52 and thence to nozzles 54, these passages being formed in the second stage of casting (FIG. 4) by the inclusion of the ceramic manifold insert 36. PDC cutters 56 are mounted in the pre-formed cutter pockets 20 (FIG. 4) in the blade edges, and hard slugs or inserts 58 are fitted in the pre-formed pockets 22 outer edges of the blades, to act as gauge protectors.

The process of the invention has the advantage that highly accurate investment casting requires a minimum of hand grinding, machining etc, prior to cutter installation, thus substantially reducing labour content involved in the standard method of producing drill bits/-coreheads.

Fusion bonding ensures integrity of bond between the shank and bit head. The casting method allows for greater flexibility in the design of fluid porting, and in cutter and gauge insert installation. The inherent accuracy of the casting process gives better quality control of cutter pockets and braze bond integrity due to the fine clearances achievable, giving good capillary action of the braze material and better self-distribution.

Injection moulded wax ensures consistency of cutter positioning and therefore of bit performance.

Thus, there has been described a method of manufacture which utilises the investment casting process to give the degree of accuracy required for producing drill bits/corehead bodies, and enables the hard facing to be applied in a two-part manufacturing process.

Modifications and variations of the above-described processes and products can be adopted without departing from the invention as defined in the appended claims.

I claim:

1. A method of casting a drill bit or corehead having a cutting part and a shank, said method comprising the steps of providing a shank element which forms at least the basis of said shank, the shank element being of a relatively less hard material, buttering the shank element with metallic coating selected from weld material and spray metal deposit each of lower melting temperature than that of a relatively hard material subsequently to form an outer shell of the cutting part of the drill bit or corehead, providing a ceramic mold of said cutting part, suspending the pre-buttered shank element in the ceramic mold, pre-heating the ceramic mold and the shank element to a predetermined casting temperature, and casting the relatively hard material around the shank element to form a relatively hard outer shell around the shank element, said step of casting comprising the imposition of conditions on said casting step which cause the relatively hard material during casting thereof to produce localized melting of said metallic coating to produce fusion bonding between said shell and said shank element.

2. A method of casting a drill bit or corehead having a cutting part and a shank, said method comprising a two-stage process wherein the first stage comprises forming a relatively hard outer shell by investment casting, said outer shall having an outer surface and an inner surface, and the second stage comprises casting a relatively less hard core material to form a core within the outer shell, the outer shell having substantially the final form of the outer part of the intended cutting part of the drill bit or corehead, and the core having at least the principal features of the final form of the shank of the drill bit or corehead, said second stage further comprising imposing conditions on said casting process which cause the core material during casting thereof to produce localized melting of the inner surface of the outer shell to produce fusion bonding between said shell and said core.

* * * * *